US005402494A

United States Patent [19]

Flippe et al.

[11] Patent Number: 5,402,494

[45] Date of Patent: Mar. 28, 1995

[54] ELECTRONIC DEVICE FORMING A PROGRAMMABLE MINIATURE HEARING AID, IN PARTICULAR OF THE INTRADUCTAL TYPE

[75] Inventors: Patrice Flippe, Perthes; Pierre Laurent, Cintray, both of France

[73] Assignee: Intrason France, Choisy Le Roi, France

[21] Appl. No.: 80,586

[22] Filed: Jun. 24, 1993

Related U.S. Application Data

[63] Continuation of Ser. No. 797,352, Nov. 25, 1991, abandoned.

[30] Foreign Application Priority Data

Nov. 23, 1990 [FR] France ..... 90 14667

[51] Int. Cl.[6] ..... H04R 25/00

[52] U.S. Cl. ..... 381/69.2; 381/68; 381/68.2; 381/68.4; 381/68.6; 381/69

[58] Field of Search ..... 381/68, 68.2, 68.4, 381/68.6, 69, 69.2

[56] References Cited

U.S. PATENT DOCUMENTS

| | | | |
|---|---|---|---|
| 4,192,565 | 3/1980 | Gianni | 439/69 |
| 4,396,806 | 7/1982 | Anderson . | |
| 4,398,235 | 8/1983 | Lutz et al. | 361/393 |
| 4,539,440 | 9/1985 | Sciarra | 381/68 |
| 4,596,902 | 6/1986 | Gilman | 381/68.2 |
| 5,001,762 | 3/1991 | Barwig et al. | 381/68.4 |
| 5,083,312 | 1/1992 | Newton et al. | 381/68 |

FOREIGN PATENT DOCUMENTS

WO90/10363 3/1990 WIPO .

OTHER PUBLICATIONS

TTL Cookbook, by Don Lancaster, 1974, p. 170.

Proceedings of the IEEE 1988 Custom Integrated Circuits Conference, "A Set of 4 IC's in CMOS Technology For A Programmable Hearing Aid", pp. 12.6.1–12.6.4.

Gordon M. Jacobs et al, "Design Techniques for MOS Switched Capacitor Ladder Filters," *IEEE Journal of Solid-State Circuits*, vol. SC-13, No. 6, pp. 267–274, Dec. 1978.

*Primary Examiner*—John K. Peng
*Assistant Examiner*—Edward Lefkowitz
*Attorney, Agent, or Firm*—Foley & Lardner

[57] ABSTRACT

A programmable intraductal hearing aid includes a microphone, a dynamically programmable filter means, an adjustable power amplifier, and a sound reproduction transducer, powered by a battery. The filter having controlled capacitors is made, together with a programming memory and its interface, in the form of at least one integrated circuit including at least one oscillator associated with at least one d.c. voltage step-up transformer for energizing the memories, the whole set being powered by a miniature low voltage battery. A power amplifier, powered by the same battery is made in a single integrated circuit provided with external decoupling capacitors.

22 Claims, 6 Drawing Sheets

1mm

ELECTRONIC DEVICE FORMING A PROGRAMMABLE MINIATURE HEARING AID, IN PARTICULAR OF THE INTRADUCTAL TYPE

This application is a continuation of application Ser. No. 07/797,352, filed Nov. 25, 1991, now abandoned.

FIELD OF THE INVENTION

The invention concerns miniature electronic devices, in particular but not exclusively, such electronic devices intended to serve as hearing aids.

From the user's point of view, there is a distinction between hearing aids which are outside the ear, those that are at least partly accommodated in the auricle or the concha of the ear (intraconchal aid), and those which are completely accommodated inside the auditory duct or canal (intraductal, or also intracanal aid).

PRIOR ART

Another factor is extremely important. It is, indeed, necessary to distinguish the hearing aids whose correction mode is programmable but in a way fixed by design, from those whose programming mode is adjustable at any time (usually called dynamically programmable hearing aids).

At present there does not exist any programmable hearing aid which would be sufficiently small to be completely accommodated in the auditory duct. In other words, there does not exist any programmable hearing aid of the intraductal type.

The reason for this is that the making of such aids poses problems that are extremely difficult to resolve.

OBJECTS OF THE INVENTION

It is a first object of the present invention to provide an electronic device allowing such an aid to be made.

It is another object of the invention to provide a device of the type which includes a microphone, programmable filtering means, adjustable amplifying means, and a battery-powered sound reproduction transducer.

SUMMARY OF THE INVENTION

The device is characterized in that the filtering means and the amplifying means are in the form of at least one integrated circuit, including at least one oscillator associated with at least one d.c. voltage step-up converter, the whole set being powered from a single miniature low voltage battery. The amplifier, powered by the same battery, can form part of the above mentioned means, or it can be made separately as a power amplifier in a single integrated circuit, provided in principle with external decoupling capacitors, possibly incorporated in the earpiece.

According to an important aspect of the invention, provision is made for two integrated circuits, one for the necessary amplification (most frequently, a preamplification before the filtering proper), and the other so as to form the programmable filter and its auxiliary circuit. In an altogether unconventional way, it has proved possible to obtain satisfactory functioning by mounting these two integrated circuits on top of one another, as will be seen below.

More particularly, the integrated circuits are obtained in the technology termed SACMOS on a hybrid circuit of the multilayer co-fired type, including the resistors, while the capacitors are implanted on the reverse side.

Very advantageously, the filtering means include in the same integrated circuit, switched capacitor filters, their control memory, and in principle its programming interface for dynamic programming. The switching of the switched capacitor filters is controlled by a crystal-controlled low frequency oscillator, and they are associated with at least one d.c. step-up transformer for a low voltage. Preferably, the latter powers a high frequency oscillator associated with another d.c. step-up converter for a high voltage. Such a high voltage is necessary for writing into the memories. The only components that are external to the integrated circuit are the crystal of the low frequency oscillator, the resistors and the capacitors.

According to another aspect of the invention, the interface responds to a single command to produce the voltage for the write to memory mode and the switch-over command for the read mode ("CHARGEMENT" or load) which minimises both the need for connections, and the size of the connector which must be associated with the hybrid circuit.

Very advantageously, the filtering means include means for adjustment near the two frequencies situated at the centre of the audible band.

The particular acoustic characteristics of the aid in accordance with the invention are improved, taking into account the resonances linked to the implantation of the device in the auricular canal, by making provision for one, or preferably several, band pass-type adjustments at the frequencies situated at the center of the audible band.

BRIEF DESCRIPTION OF THE DRAWINGS

In order that the present invention may more readily be understood the following description is given, merely by way of example, with reference to the accompanying drawings, wherein.

DETAILED DESCRIPTION OF THE PREFERRED EMBODIMENTS

Figure 1:
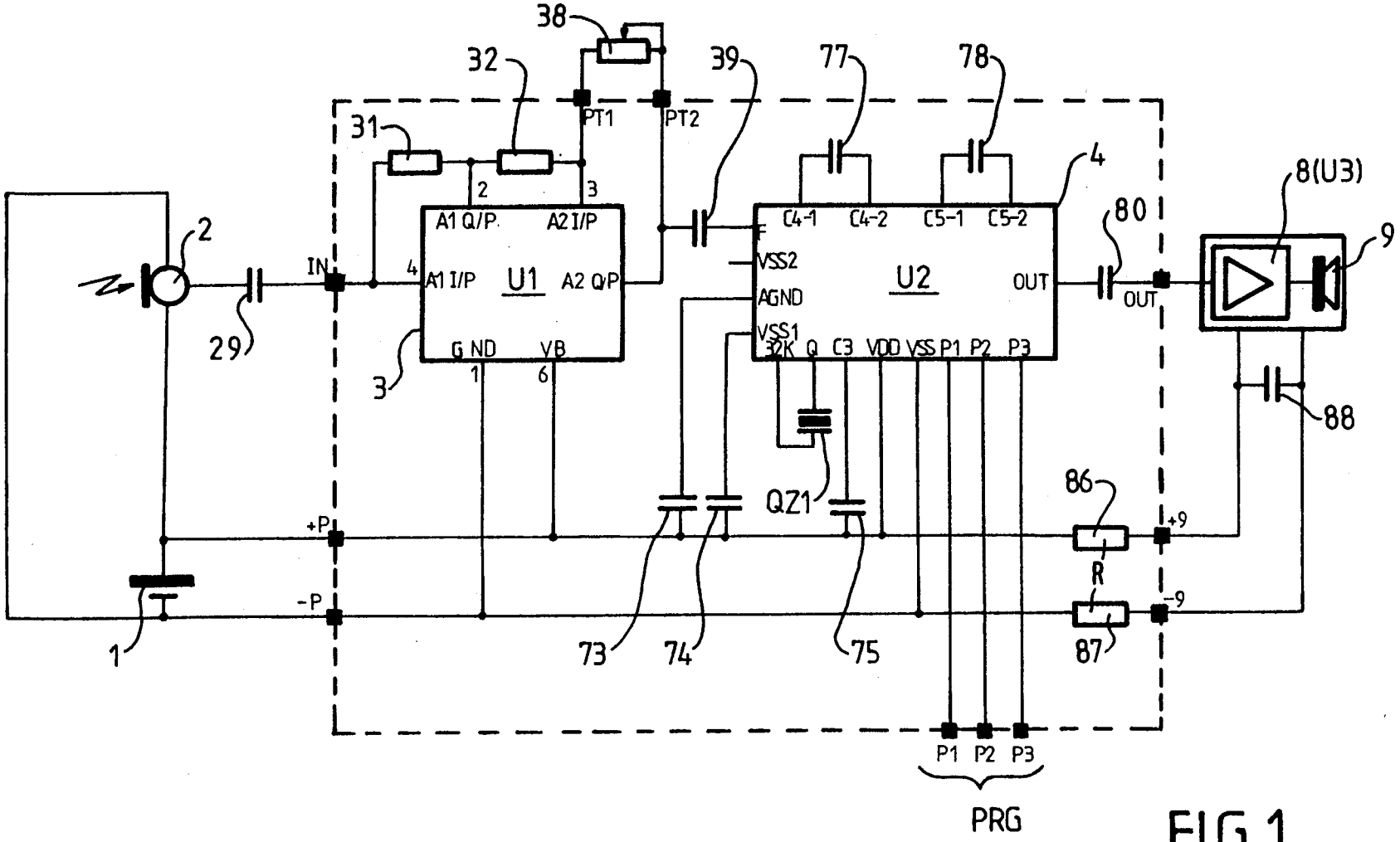
FIG. 1 is a block diagram of a device in accordance with the invention.

In FIG. 1, the device in accordance with the invention is powered by a battery 1 whose nominal voltage is 1.3 V. This is a miniature battery such as the model 312, 13, 10, 675 or any other suitable battery or accumulator.

The device comprises a microphone 2 which can be the model 3046, EA 1842, EK 3024 or any other hearing aid microphone model, preferably an electret-type model. This microphone 2 is connected via a capacitor 29 to a preamplifier 3 which is the first chip U1 of the integrated circuit. (In general, the reference numeral designates the whole circuit while the reference of the chip does not refer to circuit components outside the chip).

This chip U1 can, for example, be the model GC509/LC508 sold by the GENNUM Corporation. It is paired with two external resistors 31 and 32, as well as a miniature potentiometer 38 for the volume control.

In a variant, provision is made for a chip with a preamplifier and a variable gain amplifier, this variable gain being obtained by a switched capacitor sampling technique, in which case, an anti-fall back filter and a sampler blocking circuit are incorporated between the analog preamplifier and its automatic gain control.

The output of the preamplifier 3 is interconnected via a capacitor 39 to the filtering circuit 4 proper, which is obtained by a second integrated circuit chip U2 with external capacitors 73, 74, 75, 77 and 78. The output of the chip U2 is connected via a capacitor 80 to an earpiece which may include an optional power amplifier 8 constituted by a third chip U3. The amplified earpiece may be one of the models EP 3073, EP 3074 or EP 3075 of the KNOWLES Company. The non-amplified KNOWLES earpieces of the series ED, EH or BK, for example, may also be suitable by making a separate power amplifier chip, or by adding an additional stage to the preamplifier 3.

As will be seen below, the filter circuit 4 (and the preamplifier circuit 3 if applicable) are provided with switched capacitor stages capable of being controlled digitally (that is to say, logically) from a read-only memory which is preferably of the E2PROM type. The programming of this memory is effected by the connections PRG.

At this point, the E2PROM memory will be discussed, which is incorporated in the filter circuit 4 proper.

Figure 2:
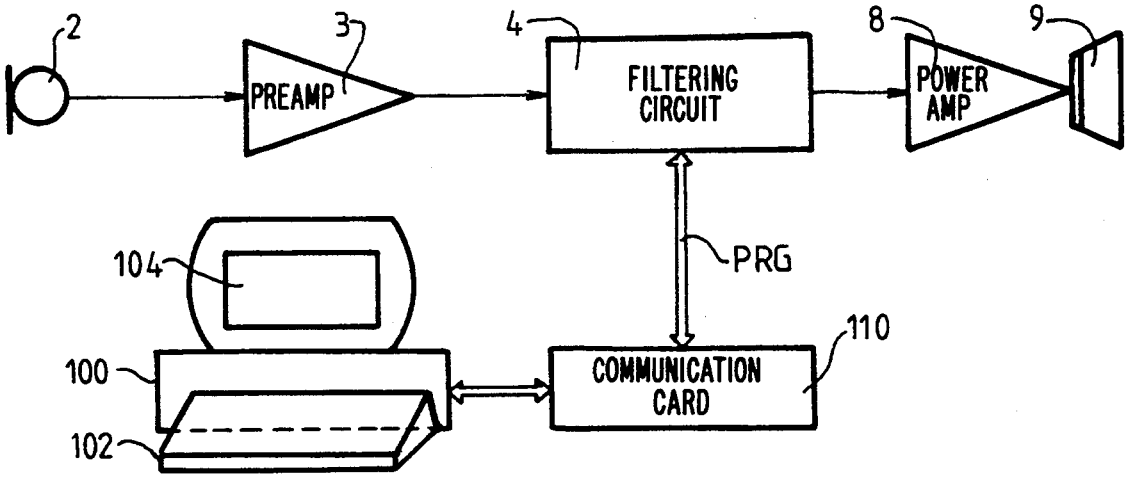
FIG. 2 is a simplified diagram corresponding to FIG. 1, but showing in addition the interconnection of the device with a microcomputer for the programming.

For the programming (FIG. 2), a microcomputer 100 is used provided in principle with a hard disk, a keyboard 102, a visual display unit 104 and a specialised internal card 110, provided for communication with the E2PROM memory. This is a card already in mass production whose technical manufacture does not pose any particular problem, this card being in principle similar to those used for programmable hearing aids already known but which are not of the intraductal type. The microcomputer is advantageously of the present standard type based on a type 8086 or 80286 processor, with an operating system of the type known under the designation MS-DOS or equivalent.

Figure 3:
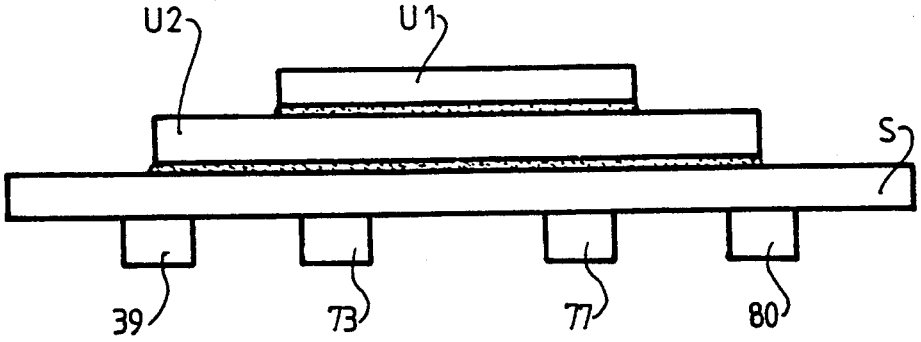
FIG. 3 is a simplified diagram of the implantation of the hybrid circuit allowing the invention to be implemented.

FIG. 3 schematically shows how the two chips U2 and U1 may be implanted on top of one another on a hybrid circuit substrate S whose upper side carries below the chip U2 a plurality of resistors (not shown).

Beneath the substrate S are implanted the capacitors of which those bearing the reference numerals 39, 73, 77 and 80 are shown. The crystal QZ1 may be mounted above the capacitors. There are then installed the microphone 2, the battery 1, the chip U3 of the amplifier 8 and its associated transducer 9 which is, of course, placed on the side facing the ear drum, while the microphone 2 is placed on the side facing the auditory canal.

Figure 4:
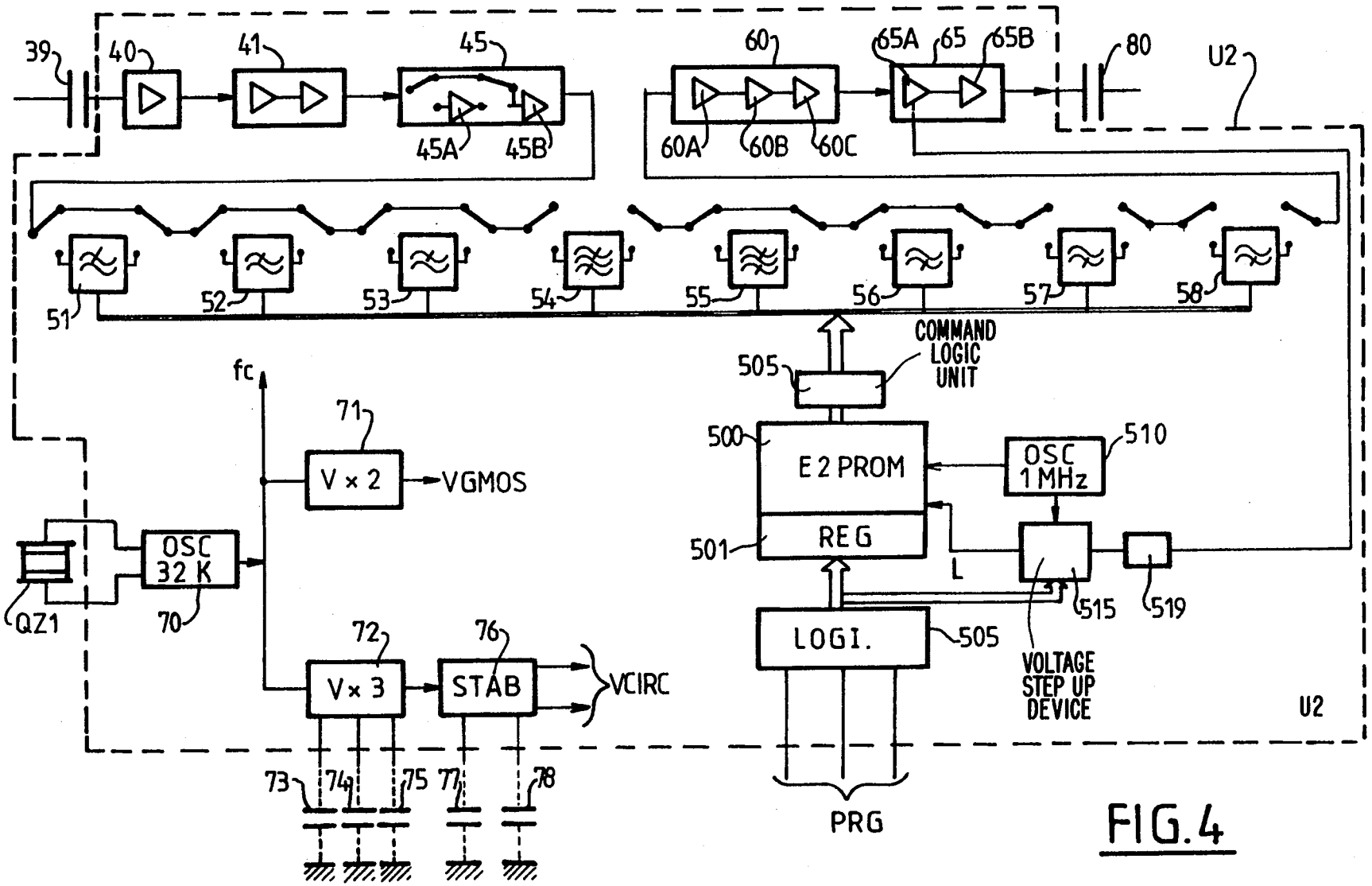
FIG. 4 is a more detailed diagram of the filtering circuit 4 or U2 suitable for implementing the invention.

In FIG. 4 there will be seen the detail of the filtering circuit 4 proper, with the boundary of its chip U2, this circuit being the most difficult to make in miniature form.

After the external coupling capacitor 39, it includes a stage 40 forming a buffer input amplifier. This stage 40 is followed by a stage 41 (with a double amplifier) having the function of an anti-fall back filter, taking into account the sampling sequence which will be considered below. Preferably, provision is then made for a stage 45 having a smoothing function and including two internal substages 45A and 45B, the first 45A being able to be short circuited. These two substages receive the switching frequency FC used for the switched capacitors and their function is to obtain the sampling required for these switched capacitors.

The output of the stage 45 is applied to a set of switched capacitor filter circuits 51 to 58, wherein the switched capacitor filter circuit comprise a sequence of filters, wherein a signal is sequentially transmitted through selected filters in the switched capacitor filter circuit, each filter having a programmable frequency and amplitude response characteristic, as shown in FIG. 4.

Each filter stage is able to be short circuited. Moreover, it is itself programmable so as to obtain several filtering levels.

The first three filters 51 to 53 are dedicated to low pass functions. The two following filters 54 and 55 are dedicated to band-pass filtering functions, preferably at the centre of the audible acoustic band. The last three filters 56 to 58 are dedicated to high pass filtering functions.

The principle of such filters is described, for example, in the article by Gordon M. JACOBS et al. entitled DESIGN TECHNIQUES FOR MOS SWITCH CAPACITOR LADDER FILTERS, IEEE Journal of solid-state circuits, Vol. SC-13, No.6, December 1978, pp 267–274.

The ability to make of such filters in the form of integrated circuits is considered in principle as being readily available to those of ordinary skill.

The filters in question, and the other switching functions of the chip U2, are controlled by the information bits contained in an E2PROM type memory 500 which can, for example, comprise twenty-four usable bits. With this memory 500, there is associated an input register 501 which communicates via a command logic unit 505 with programming connections PRG, of which there are in principle three in number to which the two power supply connections from the battery (not shown in FIG. 4) are added on the same connector.

More precisely, apart from the two power supply lines, provision is made for a signal connection, a clock connection and a connection for obtaining the read/-write command and the operation of the write voltage which will be discussed below.

An oscillator 70, operating for example at 32 kHz and assisted by an external crystal QZ1, supplies a frequency fc intended for all the switched capacitors of the chip U2. This frequency fc is also applied to two stages 71 and 72 of which the first is a voltage doubler and the second a voltage tripler. The voltage doubler 71, whose layout is of the known type, operates from integrated capacitors so as to produce at a low energy level the voltages for controlling the grids VGMOS for the field effect transistors comprised by the chip U2.

On the other hand the tripler stage 72 must provide a higher amount of energy. There are associated therewith three external capacitors 73 to 75 allowing three supply voltages to be obtained, in particular for the analog amplification stages. After stabilization in a circuit 76, also associated with two external capacitors 77 and 78, there are obtained the two active voltages Vcirc, as well as the reference voltage for the earth, not shown.

The output of the doubler 71 is thus applied in particular to an adaptation stage mounted between the read outputs of the memory 500 and the field effect transistors forming a control for the degree of filtering in the switched capacitor stages 51 to 58. The same applies to the other circuit switches, in particular both those which short circuit the switched capacitor filter stages, and those short circuiting stages such as 45 provided with such switches.

The output voltages of the stabilizer circuit 76 are applied to all the active components of the chip U2. They pass therefore in particular to the oscillator 110 and the circuits 515 and 519 associated therewith.

The oscillator 110 supplies a frequency of 1 MHz which serves in particular to control the memory 500 in the read mode and, if required, in the write mode. The output of the oscillator 510 is also applied to a stage 515 which is another voltage step-up device with integrated capacitors that is capable of providing a voltage of the order of 25 V for the programming of the memory 500 for the write mode. The capacitors can be integrated, because the write mode is relatively slow, which leaves the time necessary for the energy accumulation required for this programming.

The stage 515 depends on the write/read command already mentioned with regard to the command logic 505. In response to this command, the corresponding signal will be passed at the same time to the bit to be written in the register 501 of the memory 500 and the write command will be given by applying the output of the voltage step-up device 515 to the line L which ensures the writing or loading (LOAD) in the memory 500.

During this time, the state of the switched capacitor circuits may not be clearly determined. Consequently, an auxiliary output of the stage 515 actuates a silencing (MUTING) circuit 515 which acts on one of the amplifiers of an output circuit 65 for inhibiting the acoustic functioning.

Having thus described the set of the commands and power supply of the circuit up to the switched capacitors, it should be observed that the output of the last switched capacitor stage 58 is applied to a circuit 60 which effects a clipping process by its median amplifier 60B with, at its input, a preamplifier stage 60A before the clipping, and at the output, a wave length filter 60C. This set has the function of regulating the maximum level at the output.

The output of the stage 60 is applied to an output stage 65 which includes a smoothing stage 65A followed by an output buffer 65B.

It is the smoothing stage 65A of the element 65 which provides the muting function already mentioned.

The two substages of the circuit 45, the first and the last stages of the circuit 60, as well as the first stage of the circuit 65 receive the frequency fc for ensuring the appropriate corrections, taking into account the sampling obtained by the switched capacitors.

Of course, all the switched capacitor filters also receive this frequency fc at the same time as the command of at least one switch which is controlled by the contents of the memory 500.

Figure 5A:
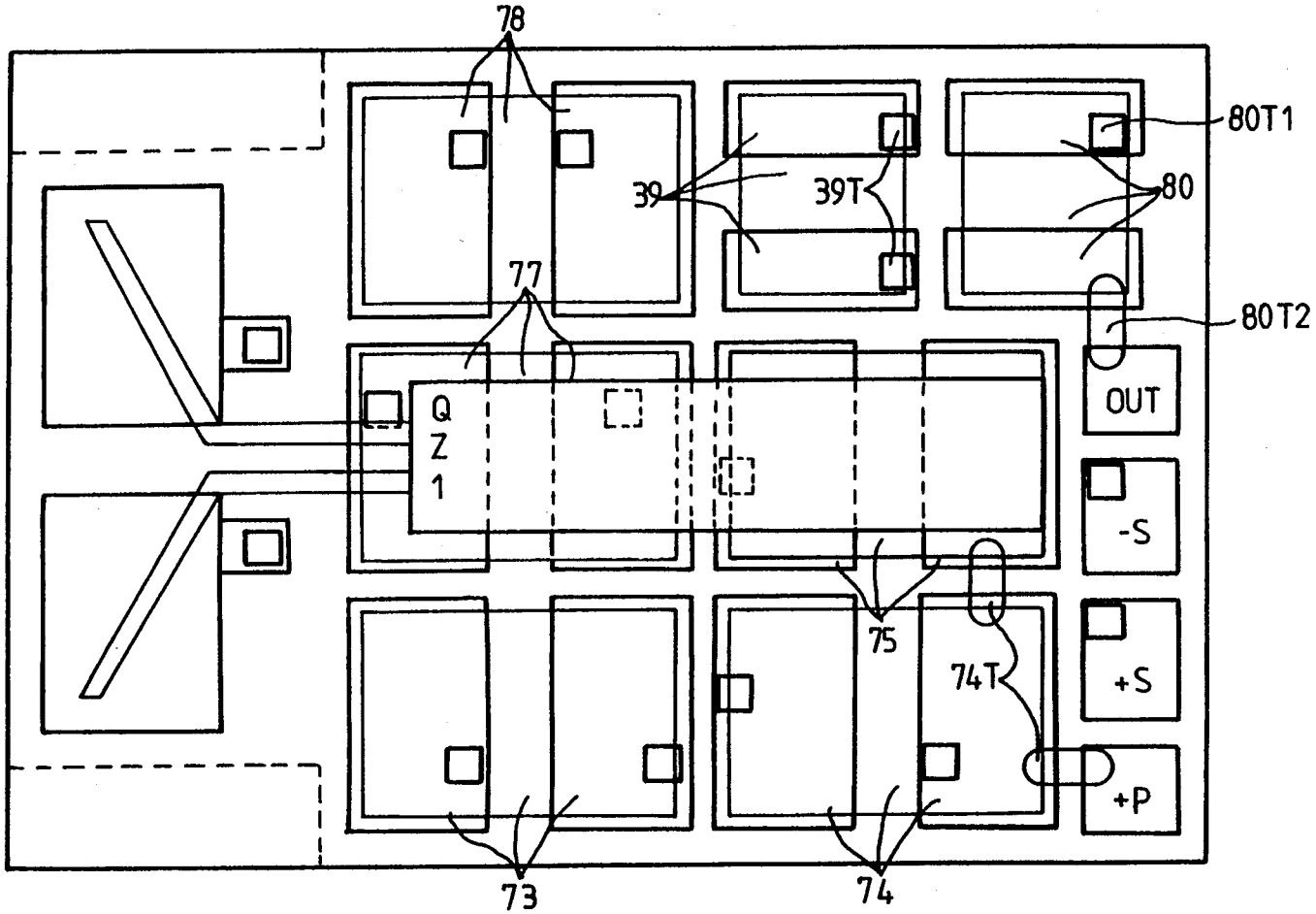
FIGS. 5A and 5B are detailed implantation diagrams of the hybrid circuit.
Figure 5B:
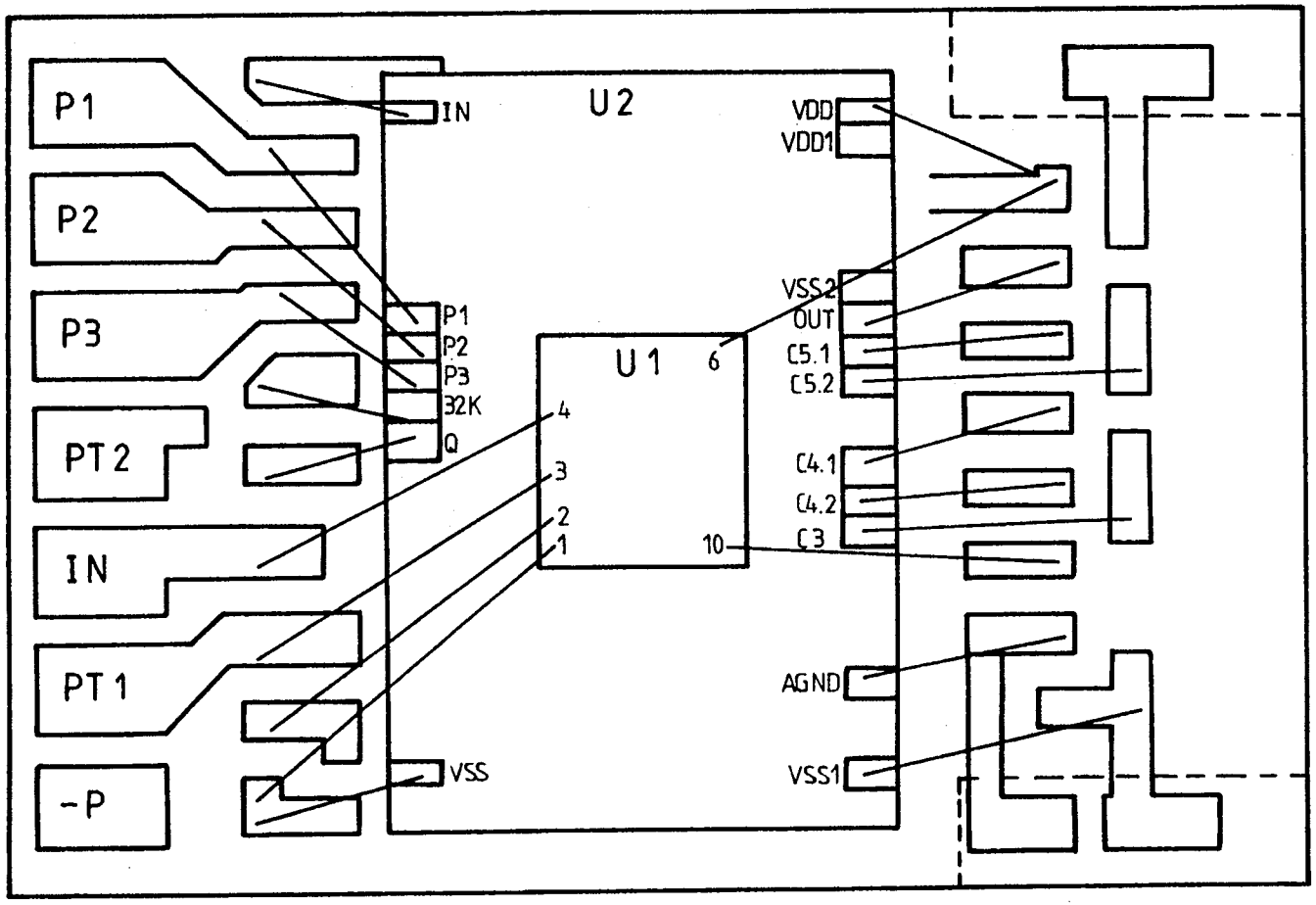

Reference will now be now made to FIGS. 5A and 5B.

On the front face (FIG. 5A) of the substrate S of the hybrid circuit, the capacitors 39, 73, 74, 75, 77, 78 and 80 are implanted in the form of a two-level metallization with which those of ordinary skill will be familiar.

There are added thereto the connection zones, on the left for the crystal QZ1 which surmounts the central capacitors 75 and 77, and on the right for the output connections (hot point OUT and the power supplies +S, −S), and the positive pole P+ of the battery.

On the reverse side (FIG. 5B), provision is made for the connection zones with the other (input/output connections on either side of the central stack of the two chips U1 and U2.

The hybrid circuit is made up of five layers. Under the chips, the resistors are applied by serigraphy to the intermediate layers.

The making of the circuit in accordance with the invention with the small size required by an intraductal hearing aid has posed considerable technical problems.

It has, first of all, been necessary to integrate the required functions in the filter chip U2 (FIG. 4) and to solve the problems of the power supply for it.

Subsequently, it was necessary to design a hybrid circuit capable of receiving the two chips U1 and U2 with their auxiliary components, while keeping to very small dimensions.

For this purpose, we first resorted to fixing a chip U2 in a way quite unusual in hybrid technology on a zone where resistors had already been implanted, and furthermore, to fixing a second chip U1 on the first. It has proved possible to cause such a set-up to function contrary to the hybridization rules currently accepted, provided that the insulating bonding agent for fixing the chips does not overflow beneath them and has a reduced thickness of the order of 50 microns.

Figure 6B:
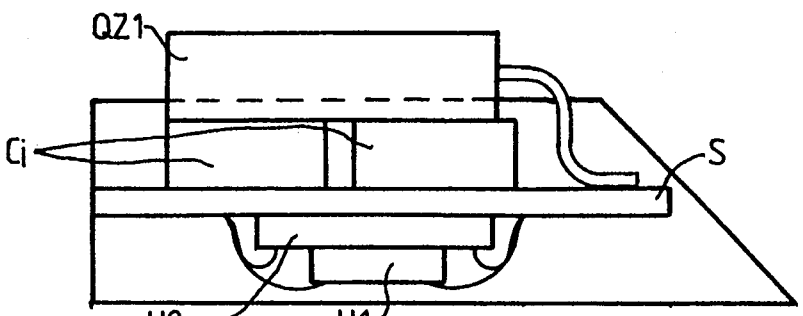
FIGS. 6A to 6C are general implantation diagrams of the device in accordance with the invention.
Figure 6C:
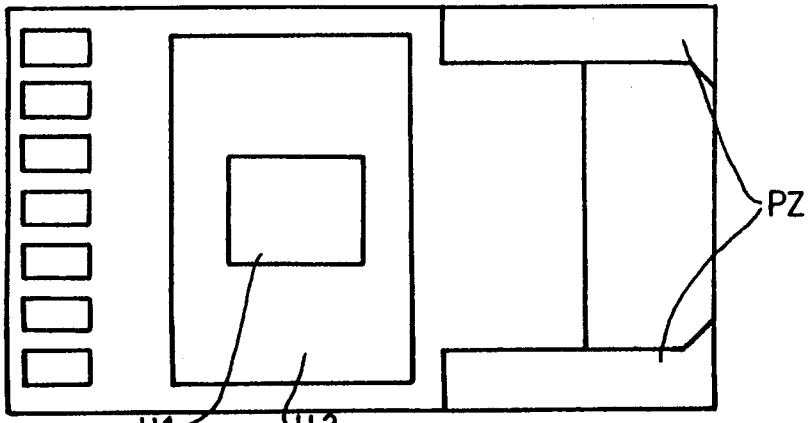
Figure 6A:
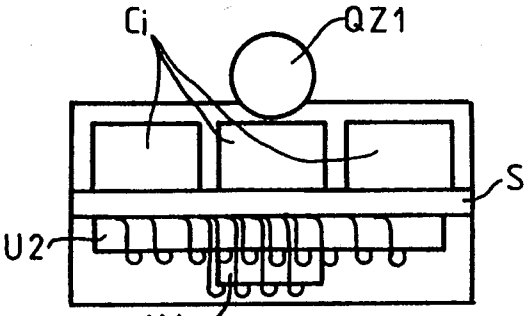

Moreover, only the so-called low temperature multilayer co-fired technology with 5 preperforated layers, holes metallized before firing, and serigraphy of the resistors also effected before firing, has made it possible to restrict the bulk of the stacks of chips with their peripheral connections to the desired dimensions. This was possible because a precise adjustment of the resistors is not necessary. The interconnections from one side to the other are then obtained without any additional lateral space requirement. FIGS. 6A to 6C show the complete implantation of the aid enlarged substantially ten times.

The diagram only shows the hybrid circuit. The microphone, amplified earpiece and volume potentiometer are connected thereto by jumpers. Their implantation is effected to minimize the occupied space.

Thus the hybrid circuit extends longitudinally along a parallelepiped shape that can be seen in FIG. 6 whose length is less than approximately 11 mm, and the width is less than approximately 6 mm, the height being of the same order.

This aid enters easily into even a small auricular canal. The cutout PZ allows the microphone to be placed on the right or left side, according to the auditory duct concerned.

Experience has shown that since this aid modifies the internal geometry of the auricular canal, it is important to make provision for adjustments at the centre of the band of usable acoustic frequencies by means of so-called "hollow" filters.

According to the invention, these adjustment are effected at one or two kHz and at 3 kHz.

The choice of the frequency of one or two kHz is programmable.

The two filters are able to be short-circuited and have, moreover, two different filtering states. Their attenuation at the centre may go as far as −12 dB, for a V attenuation curve, with a width at mid-height of approximately +/− 30% of the central frequency.

The band pass filters have a slope programmable to four values: 0 dB/octave, 6 dB/oct., 12 dB/oct. and 18 dB/oct. The cut-off frequency is programmable to 250 Hz, 500 Hz, 1 kHz, 1.5 kHz, 2.5 kHz and 3 kHz, with a setting accuracy of +/−5%.

The high pass filters have a slope programmable to four values: 0 dB/octave, 6 dB/oct., 12 dB/oct. and 18 dB/oct. The cut-off frequency is programmable to 1 kHz, 2 kHz, 3 kHz, and 4 kHz with a setting accuracy of +/−5%.

The programmable clipper circuit limits the amplitude of the output signals within the range of 15 to 80 millivolts RMS (+/−5%), in steps of 15 mV RMS. It can be programmed outside the circuit.

Experience has shown that the aid has excellent general characteristics, in particular in terms of the noise level (which is a critical parameter with switched capacitor filters). It has been very well received and used by the users to whom it has brought a major improvement.

We claim:

1. An electronic, miniature programmable hearing aid of the intraductal type, comprising a microphone and filtering and amplification means associated with a battery powered sound reproduction transducer, wherein (a) said filtering and amplification means has at least one integrated circuit, comprising at least one oscillator associated with at least one d.c. voltage step-up converter;

(b) said filtering and amplification means is powered by a miniature low voltage battery; and (c) said amplification means is powered by said miniature low voltage battery and is in a single integrated circuit provided with external decoupling capacitors wherein said hearing aid is introductal and programmable in frequency response.

2. A device according to claim 1, wherein said filtering and amplification means includes an integrated amplifier circuit and a programmable integrated filter circuit, said integrated circuits being mounted one on top of the other.

3. A device according to claim 2, wherein said integrated circuits are of the SACMOS technology, on a hybrid circuit of the multilayer co-fired type, comprising resistors on a first side and, capacitors implanted on the reverse side.

4. A device according to claim 1, wherein the filtering means include, in said single integrated circuit, switched capacitor filters, a control memory and a programming interface; switching of said switched capacitor filters being controlled by a low frequency crystal controlled oscillator associated with at least one d.c. step-up converter for a low voltage, which energizes a high frequency oscillator associated with another d.c. step-up converter for a high voltage for providing a write voltage for said memories; the crystal of the low frequency oscillator of the resistors and of the capacitors being external to the integrated circuit.

5. A device according to claim 4, wherein said programming interface responds to a single command for producing said write voltage for writing into the memory and a command for switching to the write mode, thereby minimizing the need for connections and the size of a connector.

6. A device according to claim 1, wherein said filtering means comprises means for adjustment in the vicinity of two frequencies situated at the center of the audible band.

7. A device according to claim 3, wherein said hybrid circuit extends along a parallelepiped shaped space, having a length less than approximately 11 mm, and a width less than approximately 6 mm.

8. A device according to claim 1, wherein said filtering means comprises a bandpass and a high pass filter, said bandpass and high pass filters having programmable cutoff frequencies and rolloffs.

9. A device as recited in claim 8 wherein said filtering means are switched capacitor filters.

10. An electronic miniature programmable hearing aid of the intraductal type comprising:

(a) an amplifier; and (b) a switched capacitor filter bank receiving a signal from said amplifier, said switched capacitor filter bank having frequency response characteristics programmable in amplitude and in slope, said electronic miniature programmable hearing aid being intraductal.

11. An electronic miniature programmable hearing aid of the intraductal type comprising:

(a) an amplifier; and (b) a switched capacitor filter bank receiving a signal from said amplifier, said switched capacitor filter bank having frequency response characteristics programmable in amplitude and in slope, said electronic miniature programmable hearing aid being intraductal, wherein said switched capacitor filter bank comprises a sequence of filters, wherein said signal is sequentially transmitted through selected filters in said switched capacitor filter bank, each filter having a programmable frequency and amplitude response characteristic.

12. A device as recited in claim 11, wherein said sequence of filters comprises at least one low pass filter, at least one band-pass filter, and at least one high-pass filter.

13. A device as recited in claim 11, wherein said filters have a programmable band-reject zone.

14. A device as recited in claim 13, wherein a center of said band-reject zone is programmable.

15. A device as recited in claim 13, wherein a slope of edges of said band-reject zone is programmable.

16. A device as recited in claim 13, wherein a slope of edges of said band-reject zone is programmable in a plurality of steps.

17. A device as recited in claim 12, wherein said low pass filters have a programmable band-reject amplitude.

18. A device as recited in claim 12, wherein said bandpass filters have a band-reject zone with edge slopes programmable to one of 0 dB/octave, 6 dB/octave, 12 dB/octave or 18 dB/octave.

19. A device as recited in claim 12, wherein said bandpass filters have a band-reject zone programmable to one of 1 kHz, 2 kHz, 3 kHz, or 4 kHz, with respect to the center frequency of said band-pass filter.

20. A device as recited in claim 12, wherein said high-pass filters have a band-reject zone with edge slopes programmable to one of 0 dB/octave, 6 dB/octave, 12 dB/octave or 18 dB/octave.

21. A device as recited in claim 12, wherein said high-pass filters have a band-reject zone programmable to one of 1 kHz, 2 kHz, 3 kHz, or 4 kHz, with respect to the center frequency of said high-pass filter.

22. A device as recited in claim 11, further comprising switches for routing said signal through said selected filters and bypassing others of said filters.

* * * * *